US005145357A

United States Patent [19]

Shan Chou

[11] Patent Number: 5,145,357

[45] Date of Patent: Sep. 8, 1992

[54] PLASTIC LIGHTER

[76] Inventor: Pi Shan Chou, No. 1, Lane 103, Fu Kuo Road, Hsin Chuang City, Taipei Hsien, Taiwan

[21] Appl. No.: 657,849

[22] Filed: Feb. 20, 1991

[51] Int. Cl.[5] ..... F23Q 2/00

[52] U.S. Cl. ..... 431/143; 431/254; 431/344

[58] Field of Search ..... 431/344, 253, 254, 255, 431/274, 277, 276, 130, 131, 150, 142, 129, 143

[56] References Cited

U.S. PATENT DOCUMENTS

| | | | |
|---|---|---|---|
| 3,895,904 | 7/1975 | Kimball | 431/254 |
| 3,895,905 | 7/1975 | Nissen | 431/254 |
| 4,859,174 | 8/1989 | Zellweger et al. | 431/344 |
| 4,929,174 | 5/1990 | Wang | 431/344 |

*Primary Examiner*—James C. Yeung
*Attorney, Agent, or Firm*—Bacon & Thomas

[57] ABSTRACT

A plastic lighter is disclosed having an improved control valve, gas nozzle, and pressing plate. Two opposite sub-walls are provided in the gas reservoir to form a capillary groove to enable a liquid gas to flow upwards by means of capillary effect. The gas control valve has a section of outer threads in a lower part, a seal ring mounted around a neck portion, and disc portion on an upper part. The disc portion has a ratchet gear to carry out the flame adjustment. The gas control valve has a cylindrical hole for receiving a gas nozzle to control the flow of gas. A leaf spring made of plastic material to be molded integrally with the pressing plate and extends into a cylindrical reservoir beside that flint base so as to bias the pressing plate to push the gas nozzle downwards in order to close the gas nozzle.

5 Claims, 5 Drawing Sheets

PLASTIC LIGHTER

BACKGROUND OF THE INVENTION

In the current and conventional plastic lighter, a sponge rod is usually mounted in a transparent gas reservoir to form a gas-flow passage to connect the gas flow system and the gas regulating system. The gas regulating system includes a flame adjuster with inner ratchet teeth to be mounted around a valve member. Whenever the flame adjuster is turned, the valve member will be moved upwards or downwards so as to control the flow of gas. The gas ignition system includes a pressing plate to control the flow of gas. A fire-striking wheel can be rotated to ignite the gas flowing out. The aforesaid structure has been used for over ten years without any major change. However, it has some drawbacks, such as: a complicated structure, which requires it to be assembled through complicated steps; and it has incomplete functions and poor ignition efficiency. In view of the aforesaid drawbacks, the lighter according to the present invention has been improved: (1) to simplify the gas flow system; (2) to simply the gas regulating system to improve its function; and (3) to improve the gas ignition system with better ignition efficiency. Since the number of parts of the present invention have been reduced, the assembling operation for the lighter will be considerably improved.

SUMMARY OF THE INVENTION

This invention relates to an improvement of a plastic lighter in (1) the gas flow system, (2) the gas regulating system, and the gas ignition system, of which the structures thereof are described as follows:

(1) The gas flow system

In a conventional lighter, the gas reservoir has a reinforced inner wall, and a sponge rod to guide the out flowing gas.

In the present invention, the inner wall has been replaced with a capillary groove extended to the outlet of the gas reservoir so as to guide the gas so as to flow out of the gas reservoir. The capillary groove not only can save the conventional sponge rod, but also can reduce the assembling cost of the lighter. In the transparent reservoir of a lighter, there are no parts but a clean liquid gas.

(2) The gas regulating system

In a conventional plastic lighter, the gas control valve usually includes three parts: a valve member, a gas nozzle, and a bottom cap. In the present invention, the valve member and the bottom cap are molded integrally into one piece, i.e., a gas control valve. The gas control valve has a round flange, which is cut into an aperture having a suitable width by means of an ultra-sonic machine. By means of the aperture (or cut) and a salient piece, the flame of the lighter can be adjusted exactly.

In the conventional lighter, the ratchet gear of the valve member is usually unable to accurately adjust the flame of the lighter.

This invention has further simplified the parts of the a lighter so as to simplify the assembly operation of a lighter as well.

(3) The gas ignition system

In the conventional lighter, a metal spring is usually mounted in the valve member, while the present invention is mounted with a plastic leaf spring to replace the metal spring. The plastic leaf spring is molded integrally with the pressing plate, one end of which is furnished with two plastic walls so as to have the sparks of flint converged to the gas nozzle to improve the ignition function.

DETAILED DESCRIPTION OF THE PREFERRED EMBODIMENTS

Figures 1, 4:
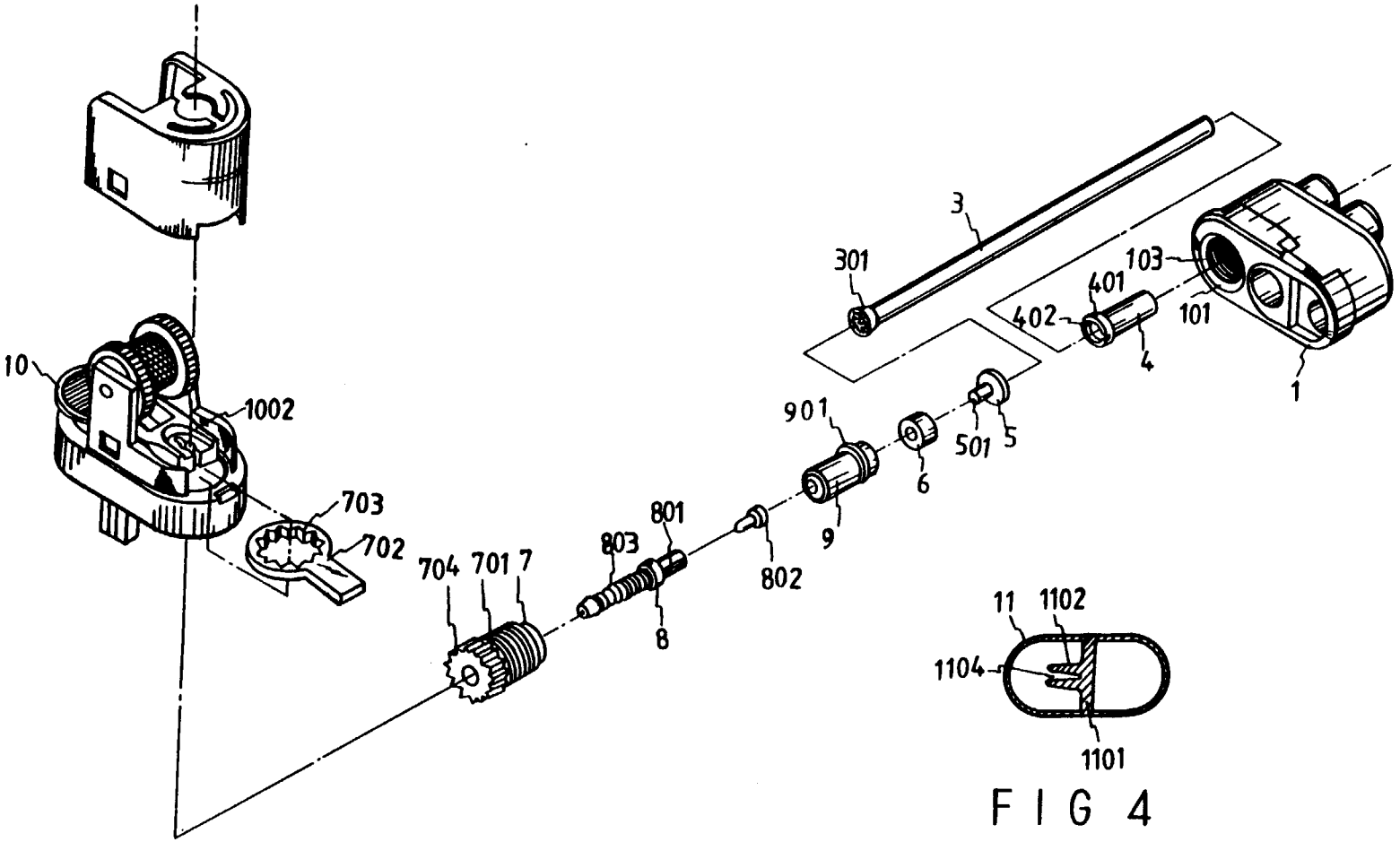
FIG 1 (PRIOR ART)
FIG. 1 is an exploded perspective view of an embodiment according to a conventional lighter.
FIG. 4 is a cross-sectional view of a lighter according to the present invention.
Figure 2:
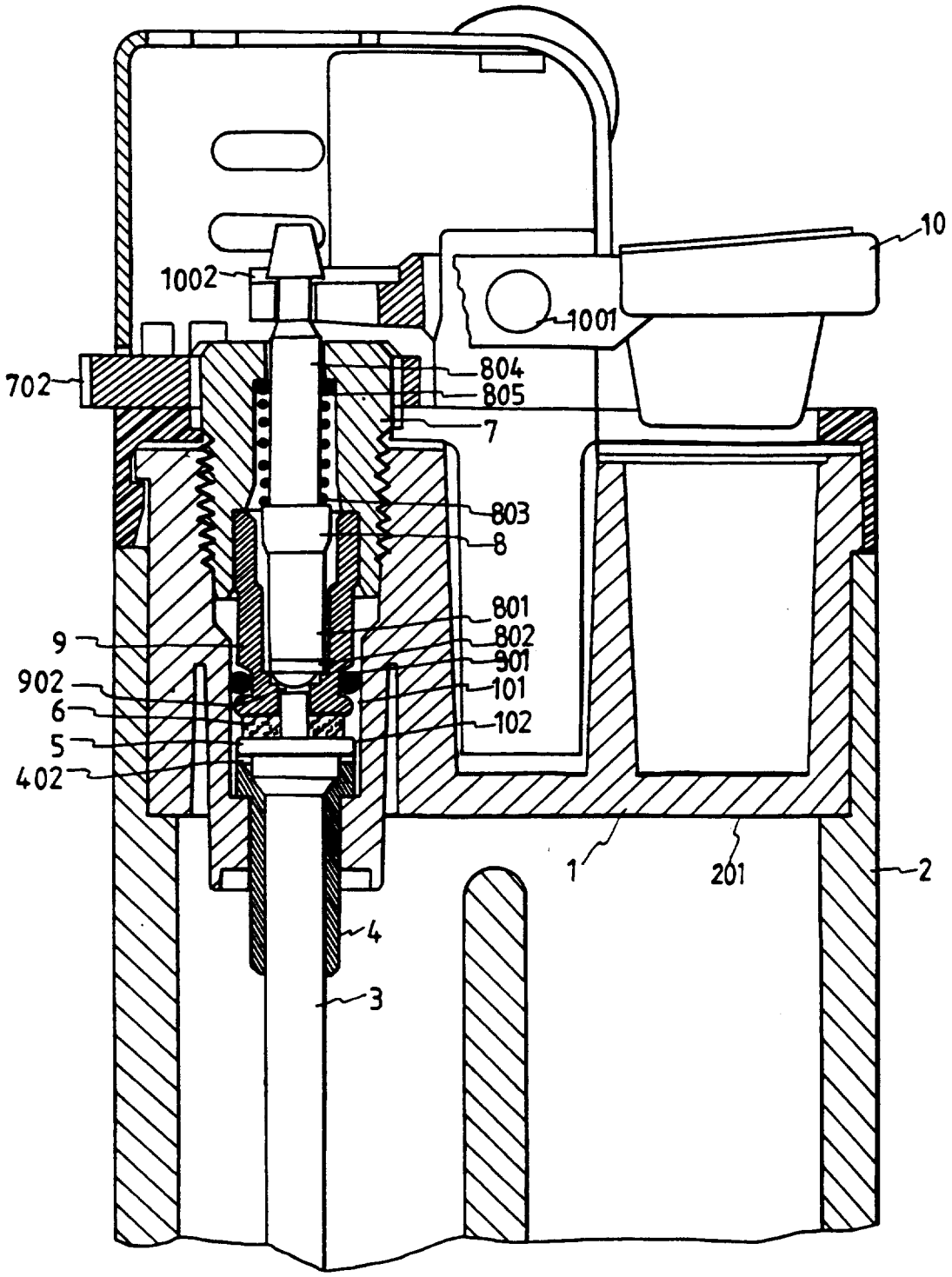
FIG 2 (PRIOR ART)
FIG. 2 is a partial, cross-sectional view of a conventional lighter

A conventional plastic lighter as shown in FIGS. 1 and 2 usually has a complicated structure, in which a valve base 1 and a gas reservoir 2 are welded together with an ultrasonic welding method along a welding line. The prime structure of the lighter comprises a sponge rod 3, of which a flange 301 is mounted in a metal cylinder 4, with a flange portion 401 of the metal cylinder having a cut 402, through which gas can pass. The metal cylinder 4 is mounted in a round recess 101 of the valve base 1. The top of the metal cylinder 4 is mounted with a nail-shaped member 5, on which a regulating washer 6 is mounted. The outer diameters of the nail-shaped member 5 and the regulating washer 6 are slightly smaller than the inner diameter of the round recess 101 so as to provide a suitable gap 102 between them and to let a liquid gas go upwards through the sponge rod 3, the cut 402 of the metal cylinder 4 and the gap 102 until reaching the regulating washer 6 made of sponge. Then, and soon as the outlet 902 of the bottom cap is opened, the liquid gas will be vaporized out of a nozzle. This is general gas passage in a conventional lighter.

The round recess of the valve base 1 has inner threads 103 for mounting a valve member 7 that has outer threads 701. A plastic nail 802 is mounted in a bottom portion 801 of a gas nozzle 8 while a seal spring 803 is mounted around the gas nozzle 8. An O-shaped seal ring 805 is mounted on the upper end of the nozzle 8. All the aforesaid parts assembled together are plugged in the bottom cap 9 before the same is plugged into the valve member 7. One end of the bottom cap 9 is mounted with an O-shaped seal ring 901.

Referring to FIG. 1 again, the flame regulating method of a conventional lighter is done by means of a flame adjuster 702, of which the inner ratchet teeth 703 are mated with and extend around the ratchet gear 704 of the valve member 7. When the flame adjuster 702 is turned by a user, the valve member can move back and forth to drive the bottom cap 9 to press the regulating washer 6 made of sponge. Whenever the thickness of the regulating washer 6 is varied, the flow of the gas can be controlled. When the fire-striking wheel is rotated by a user, a flint in the lighter will be struck to produce sparks. Simultaneously, the finger that drives the fire-striking wheel would also press the pressing plate 10 to cause a clamp fork 1002 to lift the neck of the gas nozzle 8 as a result of pivot 1001 which provides a fulcrum. In that case, the outlet 902 of the bottom cap 9 will be opened with the plastic nail 802, and then the liquid gas will be vaporized as it flows out of the gas nozzle 8 and will be ignited by the sparks.

The aforesaid conventional lighter has a complicated structure because of a plurality of parts, which cause a higher cost for assembly. It is impossible to assembly such a lighter through an automatic production line. The lighter according to the present invention has a simple structure with less parts, and therefore it can be assembled through an automatic production line. Some parts thereof can be made with injection molding, and the manufacturing and parts costs can be lowered considerably.

The structure of the present invention is described in detail with three systems as follows:

(1) Gas flow system

In the present invention, the sponge rod as used in a conventional lighter has been removed so as to reduce the parts cost and assembling cost.

As shown in FIG. 4, two opposite sub-walls 1102 are provided on an inner wall 1101 in the plastic gas reservoir 11. The two opposite sub-walls 1102 extend from the bottom of the gas reservoir to a gas outlet 1103 to form a capillary groove 1104. The width of the capillary groove 1104 is designed as such that the liquid gas flows upwards to the gas outlet 1103 as a result of the surface tension thereof.

According to the present invention, the capillary groove 1104 is defined by integral self-contained parts without any assembling operation, being free from trouble. So far as an invention is concerned, that capillary groove can provide a new function, and simplify the parts of a lighter. Therefore, it can reduce the assembling cost of a lighter, and is deemed a patentable disclosure.

(2) Gas regulating system

It includes (A) a gas regulating mechanism and (B) a gas control valve, which are described as follows:

(A) Gas regulating mechanism

Figure 3:
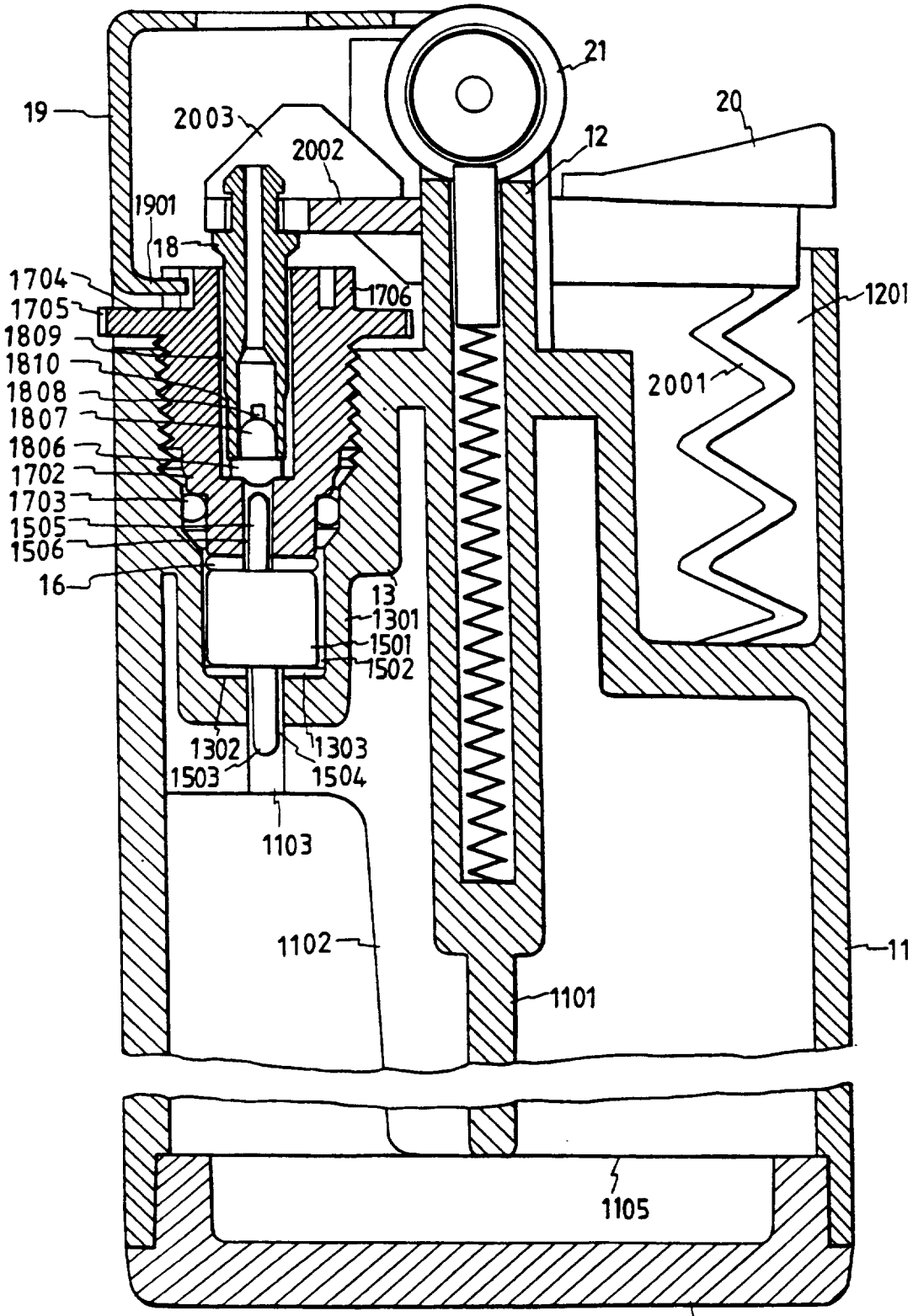
FIG. 3 is a cross-sectional view of an embodiment according to the present invention.

As shown in FIG. 3, the gas reservoir 11, the flint base 12 and the valve seat 13 of the present invention are molded into one plastic piece. An opening 1105 is provided at the bottom of the gas reservoir 11. As soon as a liquid gas is filled in the reservoir, a bottom lid 14 is welded thereon by means of an ultra-sonic welding method.

Figure 6:
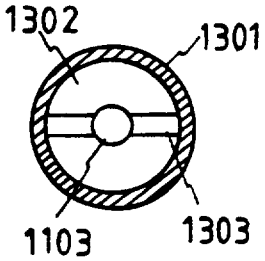
FIG. 6 is a cross-sectional view of the valve seat portion of the present invention.

The gas outlet 1103 of the gas reservoir 11 is in communication with a cylindrical chamber 1301 of the valve seat 13. The bottom portion 1302 of the cylindrical chamber 1301 has a groove 1303 (as shown in FIG. 6), which penetrates the gas outlet 1103 horizontally. A bi-nail member 15 is mounted in the bottom portion 1302 of the chamber 1301. The diameter of the body portion 1501 of the bi-nail member 15 is slightly less than the inner diameter of the cylindrical reservoir so as to provide a gap 1502 between them. The lower tip 1503 of the bi-nail member extends into the gas outlet 1103 to form a suitable gap 1504 between them. The upper tip 1505 of the bi-nail member extends through a sponge pad 16 and a valve hole of the gas control valve 17. There is a gap 1506 between the upper tip 1505 and the inner wall of the valve hole. The sizes of the aforesaid gaps have to be such that a liquid gas is able to flow upwards to the gas nozzle by means of a capillary effect as a result of the surface tension of a liquid gas.

By means of the aforesaid structure, a liquid gas is able to flow upwards as a result of capillary effect to the gas outlet 1103 along the capillary groove 1104, and then to flow through gap 1504, the groove 1303, the gap 1502, the sponge pad 16 and the gap 1506. As soon as the gas nozzle is opened, the liquid gas will be vaporized and will flow out. In accordance with the aforesaid gas regulating system, the present invention has been much simplified from the conventional lighter.

(B). Gas control valve

Figure 5:
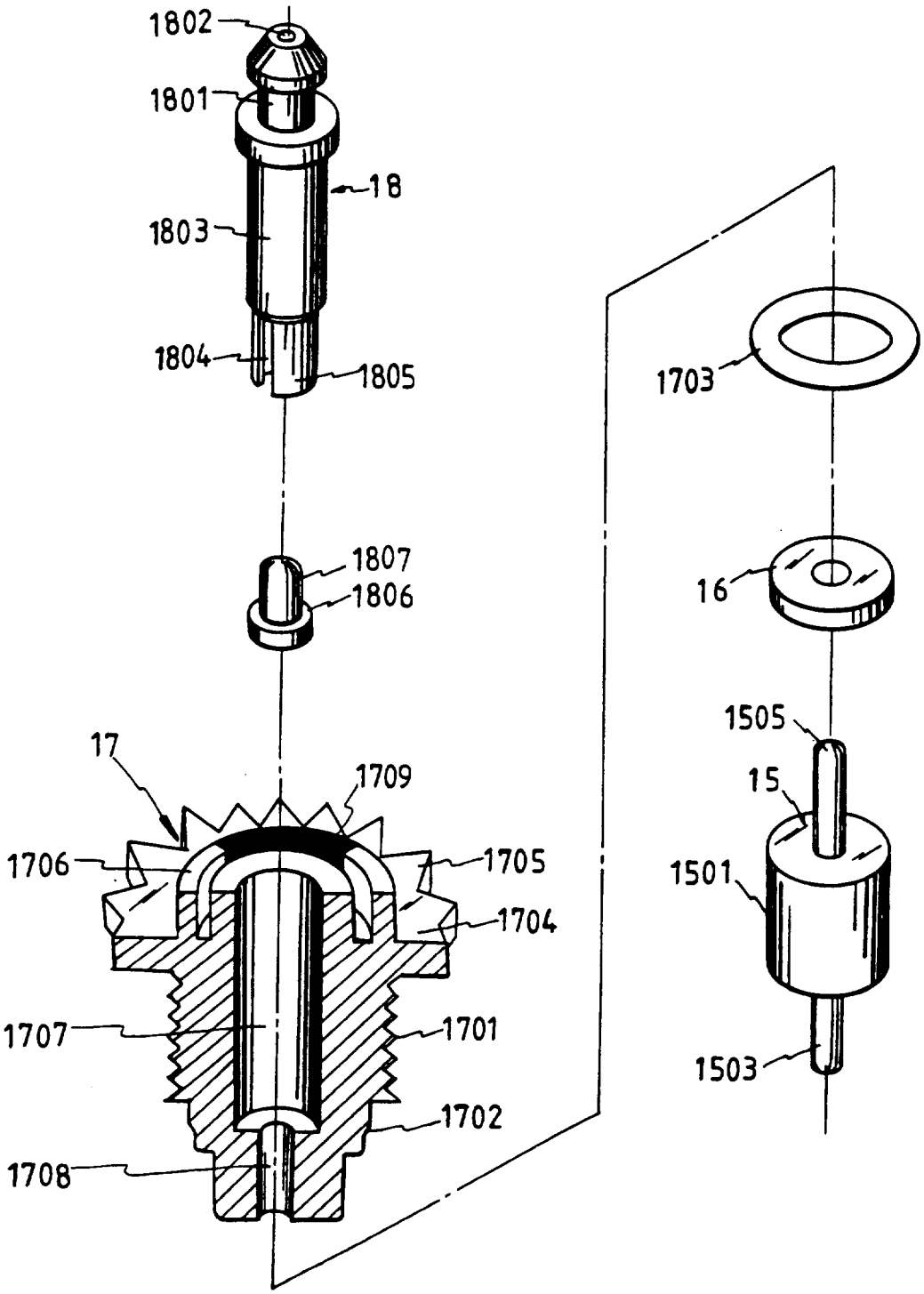
FIG. 5 is an exploded, perspective view, partially in cross-section of the cylindrical reservoir of the valve seat according to the present invention.

In the present invention, the gas control valve 17 is equal to the valve member 7 and the bottom cap 9 of a conventional lighter. As shown in FIG. 5, the lower portion of the gas control valve 17 is furnished with outer threads 1701. The neck portion 1702 of the control valve 17 is mounted with a seal ring 1703, while the upper portion thereof has a disc portion 1704 with a plurality of ratchet teeth 1705. The disc portion 1704 has a round flange 1706. The center of the gas control valve 17 has a cylindrical hole 1707 for inserting a gas nozzle 18 while the lower end of the cylindrical hole has a valve hole 1708.

The outer threads 1701 of the control valve 17 are used for affixing the control valve 17 in the valve seat 13. When the ratchet teeth 1705 are turned, the control valve 17 will press the sponge pad 16 so as to set a given flowing volume of the gas.

In a conventional lighter, when the flame adjustment is done, the gas control valve 17 must be stopped when the flame has been set at a high or low condition. In the conventional plastic lighers, the valve members usually have a slight tolerance in the thread portion thereof. In other words, the ratchet gears might not be set at the same position or angle, though the gas volume may be set at the same flow volume. Therefore, when the flame adjuster 702 is mounted around the ratchet gear 704, the inner ratchet teeth 703 might not be mated with teeth of the ratchet gear 704 proportionally and exactly. Usually they might have a tolerance of about 20 degrees, which would cause considerable difficulty in adjusting the flame of a lighter.

Figure 7:
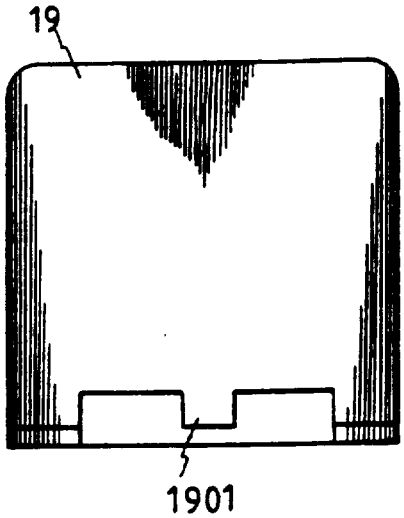
FIG. 7 is a side view of a cap according to the present invention.

In order to eliminate the aforesaid drawback of a conventional lighter, the flame adjuster according to the present invention is replaced with a ratchet gear 1705 around the disc portion 1704 of the gas control valve 17. The flame of a lighter can be adjusted by turning the ratchet gear 1705 directly. A round flame 1706 is provided on the disc portion. As soon as the flame adjustment is done, the round flame 1706 is provided with a cut 1709 at an angle of 90 degrees by means of an ultrasonic cutter. Then, a salient piece 1901 on the cap 19 and opposite the cut 1709 is furnished by means of a punching machine. The salient piece 1901 is inserted into the cut 1709 upon the cap 19 being mounted over the flint base 12 as shown in FIG. 7 so as to let the salient piece 1901 enter the cut 1709 to prevent the gas control valve 17 from rotating unintentionally. In that case, the flame of a lighter can be set at a desired height without tolerance.

As shown in FIGS. 3 and 5, the gas nozzle 18 has a neck portion 1801 and a nozzle outlet 1802 in the center thereof. The lower end of the body portion 1803 has a pin portion 1805 with a reduced diameter, on which a longitudinal groove 1804 is provided. A plastic nail 1806 is mounted in the pin portion 1805. The length of the nail portion 1807 of the plastic nail 1806 is shorter than that of the longitudinal groove 1804 so as to provide a space 1808 in the groove 1804 to let gas enter the nozzle outlet 1802.

After the gas nozzle 18 is inserted in the cylindrical hole 1707 of the gas control valve 17, there is a small gap 1809 left between the two parts because the body portion 1803 has a smaller diameter than that of the cylindrical hole 1707, while there is a big gap 1810 left between the pin portion 1805 and the cylindrical hole 1707. The plastic nail 1806 is normally mounted in place to close the valve hole 1708 at the lower end of the cylindrical hole 1707. A plastic spring 2001 according to the present invention is used instead of the metal spring as in a conventional lighter, and is molded integrally with the pressing plate 20. The spring 2001 under the pressing plate 20 can raise the plate 20 so as to place the clamp fork 2002 around the neck portion 1801 of the gas nozzle 18 pushed downwards to turn off the gas.

In the present invention, the gasified gas will enter the big gap 1810 from the valve hole 1708 by means of venturi tube theory upon the gas nozzle 18 being pulled upwards to let the plastic nail 1806 open the valve hole 1708. In that case, the gas is unable to enter the small gap 1809 as a result of the atmosphere pressure. Instead, the gas will, through the space 1808 of the longitudinal groove 1804, enter the nozzle outlet 1802 to flow out.

(3). Gas ignition system

In the present invention, a plastic leaf spring 2001 molded integrally with the pressing plate 20 is used for controlling the gas nozzle instead of a metal spring as being used in the conventional lighter. The plastic leaf spring 2001 under the pressing plate 20 extends into a cylindrical reservoir 1202 beside the flint base 12. The spring 2001 is used for raising the pressing plate 20 so as to let the clamp fork 2002 on the front of the plate 20 push the neck portion 1801 of the gas nozzle 18 downwards to close the nozzle 18.

Figure 8:
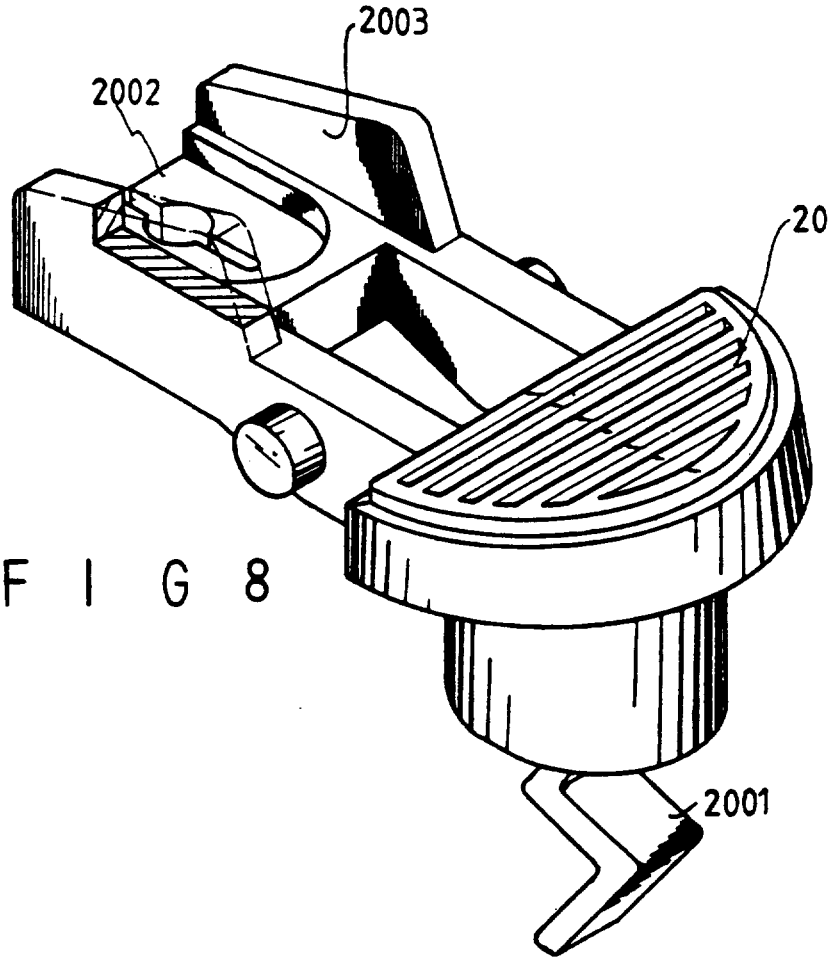
FIG. 8 is a perspective view of the pressing plate of the present invention.

As shown in FIG. 8, both sides of the clamp fork 2002 of the pressing plate 20 are furnished with two plastic walls 2003 respectively, which are used for covering a space above the fire-striking wheel 21 and the gas nozzle 18 so as to have the sparks produced with the fire-striking wheel concentrated into a beam toward the gas nozzle to surely strike a fire.

By means of the aforesaid three improvements, the lighter according to the present invention is deemed patentable because of simplifying the parts and lowering the manufacturing cost of a lighter.

What is claimed is:

1. A lighter comprising:

a) a gas reservoir molded from plastic material having an inner wall, spaced apart, opposite sub-walls extending from the inner wall to form a capillary groove to cause the upward flow of gas, a gas outlet communicating with the capillary groove, and a valve seat having internal threads and defining a groove intersecting the gas outlet;

b) a gas flow control valve having a threaded portion engaging the internal threads of the valve seat and defining a valve hole therein;

c) a gas nozzle located in the valve hole and defining a gas nozzle outlet;

d) a bi-nail member located in the valve seat and having protruding portions extending from opposite sides into the valve hole of the gas flow control valve and into the gas outlet respectively;

e) a sponge pad member operatively interposed between the bi-nail member and the gas flow control valve;

f) an adjusting member operatively associated with the gas flow control device, at least a portion of which extends exteriorly of the gas reservoir, such that rotational movement of the member rotates the gas flow control valve relative to the valve seat which thereby increases or decreases the force on the sponge pad member to thereby control the flow of gas through the gas nozzle;

g) a pressing plate member pivotally attached to the gas reservoir and operatively associated with the gas nozzle such that movement of the pressure plate member from a normal position opens the gas nozzle to allow gas to flow out of the gas nozzle; and, h) means operatively associated with the reservoir to generate a spark to ignite gas flowing out of the gas nozzle.

2. The lighter of claim 1 further comprising spring means operatively associated with the pressing plate member to bias it toward its normal position.

3. The lighter of claim 2 wherein the spring is formed of plastic material and is integrally molded with the pressing plate member.

4. The lighter of claim 1 further comprising means to limit the rotational movement of the adjusting member relative to the gas reservoir.

5. The lighter of claim 4 wherein the limiting means comprises:

a) a notch defined by the adjusting member; and, b) a cap member attached to the gas reservoir and having a portion entering the notch.

* * * * *